United States Patent [19]

Yu

[11] Patent Number: 4,577,196

[45] Date of Patent: Mar. 18, 1986

[54] MISSILE MOUNTED WAVEGUIDE ANTENNA

[75] Inventor: I-Ping Yu, Thousand Oaks, Calif.

[73] Assignee: Hughes Aircraft Company, El Segundo, Calif.

[21] Appl. No.: 481,501

[22] Filed: Apr. 1, 1983

[51] Int. Cl.[4] ..... H01Q 13/06

[52] U.S. Cl. ..... 343/705; 343/772

[58] Field of Search ..... 343/772, 776, 782–786, 343/705, 711, 708

[56] References Cited

U.S. PATENT DOCUMENTS

| | | | |
|---|---|---|---|
| 2,423,073 | 6/1947 | Willoughby | 343/772 |
| 2,810,907 | 10/1957 | Woodward | 343/771 |
| 3,380,057 | 4/1968 | Osborn | 343/786 |
| 3,458,862 | 7/1969 | Franks | 343/786 |
| 3,653,054 | 10/1970 | Wen | 343/772 |
| 4,124,851 | 11/1978 | Aaron et al. | 343/772 |
| 4,245,222 | 1/1981 | Eng et al. | 343/708 |

FOREIGN PATENT DOCUMENTS

| | | | |
|---|---|---|---|
| 949493 | 9/1956 | Fed. Rep. of Germany | 343/783 |
| 1104480 | 11/1955 | France . | |
| 2445042 | 7/1980 | France . | |
| 2506525 | 11/1982 | France . | |
| 56-4902 | 1/1981 | Japan . | |
| 938146 | 10/1963 | United Kingdom . | |

OTHER PUBLICATIONS

Walton et al., "Broad Band Ridged Horn Design," The Microwave Journal, vol. 7, No. 3, Mar. 1964, pp. 96, 97, 99–101.

*Primary Examiner*—Eli Lieberman
*Assistant Examiner*—Michael C. Wimer
*Attorney, Agent, or Firm*—Charles D. Brown; Michael W. Sales; Anthony W. Karambelas

[57] ABSTRACT

A generally rectangular waveguide antenna has two narrow side walls connected to two broad walls. One of the broad walls takes the form of a conventional rectangular ridged wall. The other broad wall is curved with the arc of the curve extending substantially the full width of the wall. The antenna has an open end and a closed end. The end of the curved broad wall extends beyond the end of the rectangular ridge wall at the open end of the antenna. The two narrow sidewalls are cut at an angle, at the open end, to join the shorter ridged wall and the extended curved wall.

4 Claims, 4 Drawing Figures

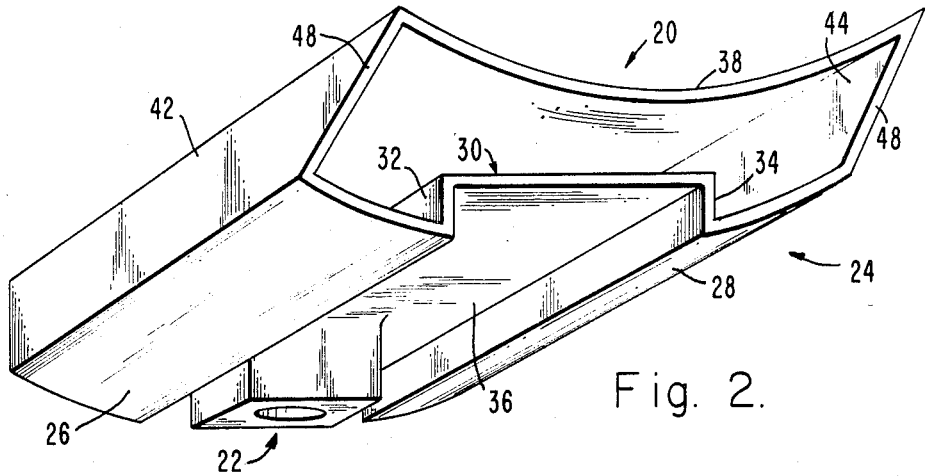
Fig. 2.
Fig. 3.
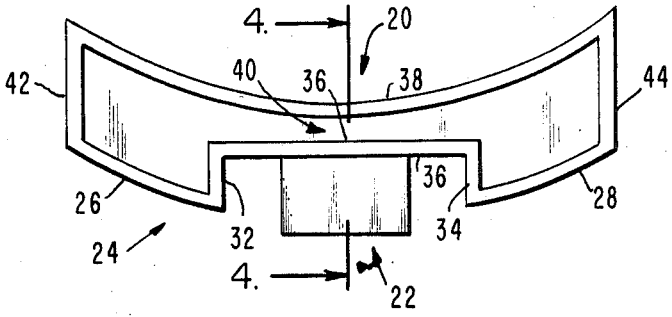
Fig. 4.
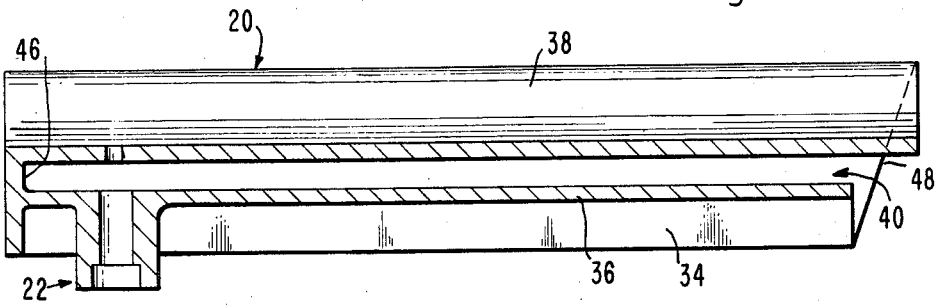

MISSILE MOUNTED WAVEGUIDE ANTENNA

The United States Government has rights in this invention under Air Force contract number F08635-82-C-0001.

BACKGROUND OF THE INVENTION

1. Field of the Invention

This invention relates to the field of ridged waveguide antennas and particularly to double ridged waveguide antennas for microwave frequency communications. The disclosed antenna is intended for mounting in the boat tail of a missile.

2. Prior Art

The art and science of designing double ridged waveguide antennas for operation in the microwave frequency range are well understood for the conventional symmetric double ridged configuration. Extensive analysis and discussion are presented in a number of trade journal articles. Pertinent background information includes Properties of Ridge Waveguide appearing in the Proceedings of the I.R.E. of August 1947 at pages 783–788 authored by Seymour B. Cohn. This article makes it clear that ridged waveguide results in a lowered cutoff frequency, lowered impedence, and wide bandwidth free from high-mode interference when compared to nonridged waveguide. The usual geometry of the ridge is rectangular, although, as shown in a 1957 article by J. Van Bladel and O. Von Rohr Jr., semicircular ridges produce certain advantages desirable in some circumstances. See Semicircular Ridges in Rectangular Waveguides, appearing in the April 1957 IRE Transactions on Microwave Theory and Techniques. See also, "On the Complete Eigenvalue Solution of Ridged Waveguide" by James P. Montgomery appearing in *IEEE* Transactions on Microwave Theory and Techniques, Vol. MTT-19, No. 6, June 1971 at pages 547 to 555 and particularly FIGS. 7 and 8 which show non-symmetric ridges. A copy of each referenced article accompanies this application.

U.S. Pat. No. 4,245,222, Dual Function Antenna, issued Jan. 13, 1981 to Edward Eng et al. shows an antenna having a cavity shape similar to that of the present invention, as best illustrated in FIG. 4. Although the shape of the cavity is somewhat similar, it should be noted that the antenna is referred to as a circumferential slot antenna, having slots 22 and 24, and is not a ridged waveguide antenna. No ridges are present in the antenna of Eng et al. A copy of that patent accompanies this application.

SUMMARY OF THE INVENTION

The invention comprises a double ridged waveguide antenna wherein the two ridge structures are dissimilar. Specifically, one of the ridges is the typical rectangular ridge, but the other ridge is an arcuate ridge with the arcuate portion extending substantially the full width of the broader wall of the waveguide. One end of the waveguide is closed. The ends of the narrow sidewalls of the open end of the waveguide are cut at an angle to join the curved broad wall to the shorter rectangular ridged wall. This configuration produces a low-band compact antenna capable of fitting within the limited volume of the missile boat tail and having narrow band characteristics. The champhered open end provides a high degree of freedom from interference from a higher frequency band antenna located nearby. The dissimilar nature of the ridges also provides for moderate cross polarization gain which is useful in the system environment.

BRIEF DESCRIPTION OF THE DRAWINGS

FIG. 2 is a perspective view of the double ridged waveguide antenna.

FIG. 3 is a view of the open end of the waveguide antenna.

FIG. 4 is a cross sectional view taken along the line 4—4 of FIG. 3.

DETAILED DESCRIPTION OF THE INVENTION

Figure 1:
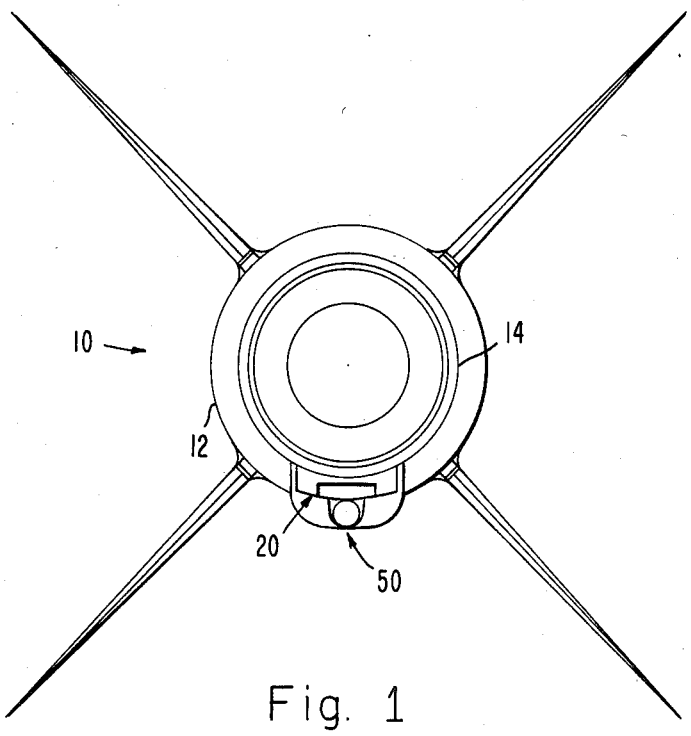
FIG. 1 is a rear end view of a missile showing the position of the antenna in the missile boat tail.

The double ridged waveguide antenna described herein is intended for installation in the boat tail of a missile as shown in FIG. 1. A rear end view of a missile 10 reveals a space located between the outer body 12 of the missile and the exit cone 14 of the rocket motor which propels the missile. The antenna has been designed to fit in this somewhat limited space. The antenna 20 is viewed as its open end in FIG. 1.

As shown in FIG. 2, microwave energy is provided to the double ridged waveguide antenna 20 via feed assembly 22 located near the closed end of the antenna. The precise location of the feed is selected to achieve desired narrowband characteristics. The first ridge of antenna 20 is the conventional rectangular ridge formed in broad wall 24. Broad wall 24 comprises wall segments 26 and 28 and includes the rectangular ridge 30 formed by generally parallel side wall segments 32 and 34 and perpendicular ridge wall 36. The second ridge of antenna 20 is the arcuate ridge 38 which forms the opposite broad wall. Arcuate ridge 38 most closely approaches ridge wall 36 near its midpoint and defines a gap 40 shown best in FIGS. 3 and 4. Perpendicular to the two broad walls are the two opposed narrow sidewalls 42 and 44.

An elevational view of the open end of the ridged waveguided 20 is shown in FIG. 3. The arcuate ridge 38 is shown extending the full width of the antenna 20. Wall segments 26 and 28 are generally parallel to the arcuate ridge 38, although the wall segments 26 and 28 could also be made flat and generally parallel to ridge wall 36. The opposite end of the antenna is closed by wall 46 as illustrated in FIG. 4.

The use of a conventional rectangular ridge on one broad wall together with a dissimilar arcuate ridge on the opposite broad wall provides a moderate cross polarization gain which is useful in the system environment.

The end of the arcuate ridge 38 which forms a part of the open end of waveguide antenna 20 extends beyond the corresponding end of broad wall 24. The proximate ends of the narrow sidewalls 42 and 44 are champhered as indicated by edges 48 shown connecting the two broad walls in FIG. 4. The extension of arcuate ridge 38 beyond ridge wall 36 provides built-in outside-band rejection and minimizes the interference with a nearby antenna 50 (shown in FIG. 1) of higher operating frequency.

What is claimed is:

1. A compact microwave antenna for mounting within a recessed free space of a missile, comprising:

a waveguide antenna having two longitudinally parallel broad walls and two longitudinally parallel narrow walls, whereby the cross-sectional area of the antenna is constant over the length of the antenna and whereby the volume of the antenna is adapted to fit entirely within the free space;

one of such broad walls including a generally rectangular ridge; and the other said broad wall being arcuate in form and most closely approaching said rectangular ridge at the center of such ridge, whereby a gap is defined between such broad walls and whereby the arcuate form is adapted to mount with convenience on an interior surface of the free space.

2. The antenna of claim 1 wherein the free space is the missile boat tail and the arcuate form is adapted for flush mounting.

3. A missile having a compact recessed mounted microwave antenna comprising:

a missile having a recessed free space;

a waveguide antenna having two longitudinally parallel broad walls and two longitudinally parallel narrow walls, whereby the cross-sectional area of the antenna is constant over the length of the antenna and whereby the volume of the antenna is adapted to fit entirely within the free space;

one of such broad walls including a generally rectangular ridge; and the other said broad wall being arcuate in form and most clearly approaching said rectangular ridge at the center of such ridge, whereby a gap is defined between such broad walls and whereby the arcuate form is adapted to mount with convenience on an interior surface of the free space.

4. The missile of claim 3 wherein the free space is the missile boat tail and the arcuate form is adapted for flush mounting.

* * * * *